US011698037B1

(12) United States Patent
Dudar et al.

(10) Patent No.: US 11,698,037 B1
(45) Date of Patent: Jul. 11, 2023

(54) FUEL SYSTEM FOR A VEHICLE AND METHOD OF CONTROLLING

(71) Applicant: Ford Global Technologies, LLC, Dearborn, MI (US)

(72) Inventors: Aed Dudar, Canton, MI (US); Dennis S. Yang, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/716,100

(22) Filed: Apr. 8, 2022

(51) Int. Cl.

| | |
|---|---|
| ***F02D 41/00*** | (2006.01) |
| ***F01N 3/08*** | (2006.01) |
| ***F02M 25/08*** | (2006.01) |
| ***F02M 35/10*** | (2006.01) |

(52) U.S. Cl.
CPC ..... *F02D 41/0032* (2013.01); *F01N 3/0835* (2013.01); *F02D 41/003* (2013.01); *F02M 25/089* (2013.01); *F02M 25/0854* (2013.01); *F02M 25/0872* (2013.01); *F02M 35/10222* (2013.01); *F02M 2025/0881* (2013.01)

(58) Field of Classification Search
CPC .. F01N 3/0878; F02D 41/003; F02D 41/0032; F02M 25/0854; F02M 25/0872; F02M 25/089
See application file for complete search history.

(56) References Cited

U.S. PATENT DOCUMENTS

| | | | |
|---|---|---|---|
| 3,907,153 | A | 9/1975 | Mutty |
| 4,395,991 | A | 8/1983 | Miyachi et al. |
| 4,762,156 | A | 8/1988 | Rich |
| 4,934,417 | A | 6/1990 | Bucci |
| 5,462,100 | A | 10/1995 | Covert et al. |
| 5,579,742 | A | 12/1996 | Yamazaki et al. |
| 5,819,796 | A | 10/1998 | Kunimitsu et al. |
| 6,405,718 | B1 | 6/2002 | Yoshioka et al. |
| 7,152,638 | B2 | 12/2006 | Ganachaud |
| 7,266,958 | B2 | 9/2007 | Milde et al. |
| 7,383,856 | B2 | 6/2008 | Martis et al. |
| 7,726,363 | B2 | 6/2010 | Benjey et al. |
| 8,132,559 | B2 | 3/2012 | Dong et al. |

(Continued)

FOREIGN PATENT DOCUMENTS

| | | |
|---|---|---|
| EP | 0781677 A1 | 7/1997 |

OTHER PUBLICATIONS

Non-Final Office Action for U.S. Appl. No. 17/243,779, dated Feb. 18, 2022, 11 pages.

*Primary Examiner* — Logan M Kraft
*Assistant Examiner* — Anthony L Bacon
(74) *Attorney, Agent, or Firm* — Brooks Kushman P.C.; Vincent Mastrogiacomo

(57) ABSTRACT

A method of controlling an evaporative emissions system for a vehicle is provided. A fuel system for a vehicle and a vehicle are also provided. A signal indicative of an entry condition associated with a secondary air flow path for a purge of an evaporative emissions canister is received. A filter is decoupled from a port of the evaporative emissions canister in response to receiving the signal and prior to the evaporative emissions canister purge. The evaporative emissions canister is purged by flowing atmospheric air into the port and through the evaporative emissions canister while the filter is decoupled from the port. The filter is coupled to the port of the evaporative emissions canister after purging the canister.

20 Claims, 6 Drawing Sheets

(56) References Cited

U.S. PATENT DOCUMENTS

| | | | | |
|---|---|---|---|---|
| 8,474,558 | B2 | 7/2013 | Ohira et al. | |
| 8,888,901 | B2 | 11/2014 | Kimoto | |
| 8,931,523 | B2 | 1/2015 | Hagen et al. | |
| 9,046,063 | B2 | 6/2015 | Landgraf et al. | |
| 9,242,551 | B2 | 1/2016 | Criel et al. | |
| 9,267,467 | B2 | 2/2016 | Peters et al. | |
| 9,545,844 | B2 | 1/2017 | Forty et al. | |
| 9,732,706 | B2 | 8/2017 | Dudar et al. | |
| 9,765,735 | B2 | 9/2017 | Walter et al. | |
| 10,280,879 | B2 | 5/2019 | Stempien et al. | |
| 10,288,013 | B2 | 5/2019 | Dudar | |
| 2004/0079079 | A1 | 4/2004 | Martin et al. | |
| 2005/0066717 | A1* | 3/2005 | Sakagami | F02M 25/0854 73/114.39 |
| 2010/0229549 | A1 | 9/2010 | Taylor | |
| 2011/0073396 | A1* | 3/2011 | Yamada | B62J 35/00 180/219 |
| 2013/0269532 | A1 | 10/2013 | Kimoto | |
| 2013/0312713 | A1* | 11/2013 | McLain | F02M 25/0818 123/518 |
| 2015/0337777 | A1 | 11/2015 | Hagen | |
| 2017/0226966 | A1* | 8/2017 | Koga | B01D 46/0036 |
| 2019/0353112 | A1* | 11/2019 | Kim | F02D 41/0045 |
| 2022/0025811 | A1 | 1/2022 | Fagerstrom et al. | |
| 2022/0120245 | A1* | 4/2022 | Dudar | F02M 25/0836 |

* cited by examiner

FUEL SYSTEM FOR A VEHICLE AND METHOD OF CONTROLLING

TECHNICAL FIELD

Various embodiments relate to a vehicle with an evaporative emissions system for an engine, and a method of controlling the evaporative emissions system.

BACKGROUND

A vehicle with an engine may be provided with an evaporative emissions system with a canister to absorb fuel vapors from the fuel tank and system. The evaporative emission system may be provided with a filter positioned between the canister and a vent to atmosphere, and this filter may be provided as a conventional filter for dust or debris, or as a second canister element to absorb fuel vapor and meet certain emissions standards. The filter further restricts air flow between the fuel tank and the vent, such air flow through the main canister may be limited during a purge process for the main canister.

SUMMARY

In an embodiment, a method of controlling an evaporative emissions system for a vehicle is provided. A signal indicative of an entry condition associated with a secondary air flow path for a purge of an evaporative emissions canister is received. A filter is decoupled from a port of the evaporative emissions canister in response to receiving the signal and prior to the purge of the evaporative emissions canister. The evaporative emissions canister is purged by flowing atmospheric air into the port and through the evaporative emissions canister while the filter is decoupled from the port. The filter is coupled to the port of the evaporative emissions canister after purging the canister.

In another embodiment, a fuel system for a vehicle is provided with a fuel tank having a fuel fill port with a closure member, and an evaporative emissions canister having a first port fluidly coupled to the fuel tank to receive vapor therefrom and a second port. The canister positioned between an air intake for an engine and a vent to atmosphere. A filter is supported by a bracket for movement between a first position and a second position, with the filter fluidly coupling the second port of the canister to the vent in the first position, and the filter spaced apart from and decoupled from the second port of the canister in the second position. A controller is configured to: receive a first signal indicative of an entry condition associated with a secondary air flow path for a purge of an evaporative emissions canister, send a second signal with instructions to decouple the filter from the second port of the evaporative emissions canister in response to receiving the first signal and during the purge of the evaporative emissions canister, and send a third signal with instructions to couple the filter to the second port of the evaporative emissions canister after the canister is purged.

In yet another embodiment, a vehicle is provided with an engine having an air intake, a fuel tank with a fuel fill port and a closure member movable between a closed position to cover the fuel fill port and an open position to fuel the fuel tank via the fuel fill port. An evaporative emissions canister has a first port fluidly coupled to the fuel tank to receive vapor therefrom and a second port. The canister fluidly connects the air intake to a vent to atmosphere. A filter is supported by a bracket for movement between a first position and a second position, with the filter fluidly coupling the second port of the canister to the vent in the first position, and the filter spaced apart from and decoupled from the second port of the canister in the second position. A controller is configured to: receive a first signal indicative of an entry condition associated with a secondary air flow path for a purge of an evaporative emissions canister, send a second signal with instructions to decouple the filter from the second port of the evaporative emissions canister in response to receiving the first signal and during the purge of the evaporative emissions canister, and send a third signal with instructions to couple the filter to the second port of the evaporative emissions canister after the canister is purged.

DETAILED DESCRIPTION

As required, detailed embodiments of the present disclosure are provided herein; however, it is to be understood that the disclosed embodiments are merely examples and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
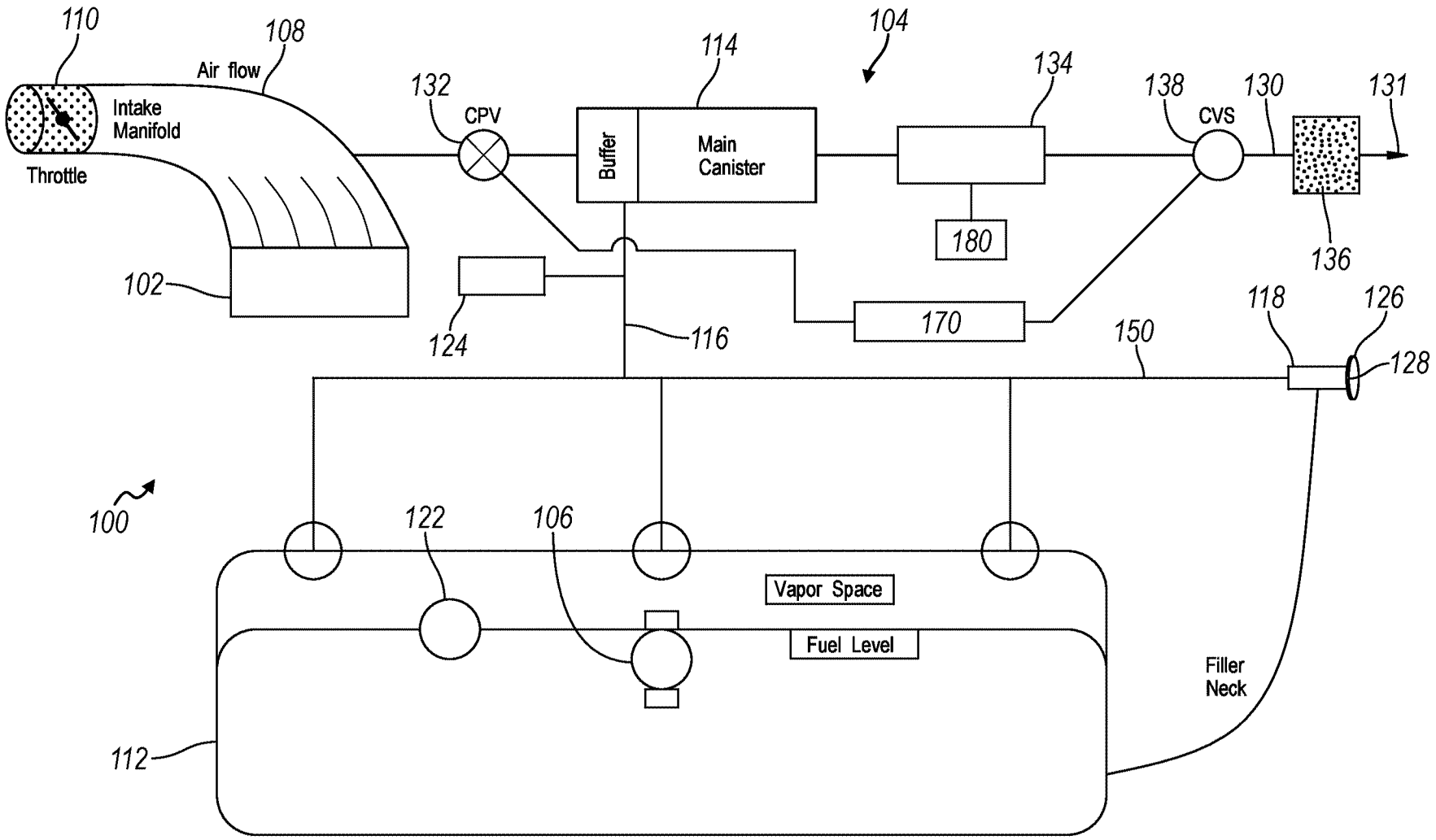
FIG. 1 illustrates a schematic for a vehicle fuel system according to an embodiment.

FIG. 1 illustrates a fuel system 100 for a vehicle. The vehicle may be a conventional vehicle, or may be a hybrid vehicle powered by both an internal combustion engine as well as another propulsion source such as an electric motor. The fuel system 100 delivers fuel to an internal combustion engine 102, and is also provided with an evaporative emissions system 104. The fuel system 100 to the engine has a fuel pump 106 to pressurize fuel to deliver to the engine 102, and may include a fuel injector system according to one example.

The engine 102 has one or more cylinders, an engine intake manifold 108 and an engine exhaust manifold (not shown). The engine intake 108 has a throttle 110 fluidly coupled to the engine intake manifold.

The fuel system 100 has a fuel storage tank 112. The fuel tank 112 is sized to receive a volume of fuel. The fuel tank may be provided by a single tank, or multiple tanks fluidly connected to one another. In various non-limiting examples, the fuel may be a liquid fuel such as gasoline, diesel, alcohol fuels, a mixture thereof, or the like. As used herein, fluid refers to a substance in its liquid phase state, vapor or gas phase state, or a saturated liquid-vapor mixture.

Vapors generated in the fuel system 100 may be directed to an evaporative emissions system 104. The evaporative emission system 104 has a fuel vapor canister 114 fluidly connected to the fuel tank 112 via a vapor recovery line 116 or vent line 116. The fuel vapor canister 114 is fluidly connected to the engine intake manifold 108 to purge vapors in the canister 114 to the engine 102.

The fuel tank 112 in the fuel system 100 may be periodically filled, fueled, refilled or refueled from an external fuel source via a fuel fill inlet 118. The fuel fill inlet 118 has a neck or filler pipe and may be sized to receive a nozzle or other fuel dispensing device of the external fuel source. According to various examples, the external fuel source may be a fuel pump at a gas station, a portable gas can or gas tank, or a mobile refueling system such as a refueling vehicle or truck. The fuel system 100 may be provided with a fuel level sensor 122 to indicate the fuel level in the fuel tank 112 to the vehicle operator, e.g. via a fuel gauge or other indicator in a vehicle instrument panel. The fuel tank 112 may additionally be provided with a fuel tank pressure transducer 124 to sense the pressure within the fuel tank, and the transducer 124 may be positioned in the vent line 116.

The fuel fill inlet 118 may be closed via a closure member 126. The closure member 126 may be a door that moves between a first, closed position to cover the fuel fill inlet 118, and a second, open position to provide access to the inlet 118 for the external fuel source. For a door as the closure member, the door may be rotatably supported relative to the fuel fill port, and movable between a first closed position to cover the fuel fill port and a second open position for fueling the fuel tank via the fuel fill port. In various examples, the closure member 126 may be provided with or without a sealing member. In other examples, the closure member 126 may alternatively or additionally include a fuel fill cap with a sealing member to seal the cap to the fuel tank 112, and prevent fluids, including vapor from exiting the fuel tank 112 via the fuel fill inlet 118 when the cap 126 is closed. Alternatively or additionally, the closure member 126 may include a valve, e.g. in a capless fuel tank. A switch or sensor 128 may be provided to detect the position of the closure member.

The fuel vapor canister 114 of the evaporative emissions system 104 may be filled with an adsorbent material, such as activated carbon, to temporarily trap or retain fuel vapors from the fuel tank 112, e.g. during fueling the fuel tank, vehicle operation, or during diurnal temperature changes causing pressure changes and fuel vaporization when the vehicle is not operating. In one example, the adsorbent material is provided as pellets that are loose packed into the canister 114. The fuel vapor canister 114 may include an atmospheric ventilation line 130 between the canister and a vent 131 to atmosphere for venting vapors from the canister 114 to atmosphere and/or for drawing fresh outside air into the canister 114.

A canister purge valve (CPV) 132 is positioned between the fuel vapor canister 114 and the intake manifold 108 to control the flow of fuel vapor from the canister 114 into the engine 102. The CPV 132 may be opened during a canister 114 purge process, for diagnostics of the evaporative emissions system 104 and/or fuel system 100, and the like.

The evaporative emissions system 104 also has a filter 134. The filter 134 may be provided as a second evaporative emissions canister 134, and be filled with an adsorbent material, such as activated carbon, to temporarily trap or retain fuel vapors from the fuel tank 112, e.g. during fueling the fuel tank, vehicle operation, or during diurnal temperature changes causing pressure changes and fuel vaporization when the vehicle is not operating. The filter 134 is positioned between the canister 114 and the vent 131. In other examples, the filter 134 may be provided as a dust filter or dustbox to remove dust, debris, or particulate matter from atmospheric air drawn into the evaporative emissions system 104, for example, during a purge process. When the filter 134 is a second canister, another filter 136 may additionally be provided as shown in FIG. 1. The another filter 136 may be used as a particulate filter for dust and or debris.

In some examples, the evaporative emissions system 104 is provided with a canister vent valve (CVS) 138 that fluidly connects the filter 134 to the atmospheric vent 131. In other examples, the evaporative emissions system 104 is provided without a CVS 138 such that there is an open flow path between the filter 134 and the atmospheric vent 131, or between filter 136 and the vent 131.

Vehicles may be required to have diagnostics to validate the integrity of the fuel system 100, including the evaporative emissions system 104, for potential leaks, and to purge the canister 114 of the evaporative emissions system 104. Generally, the evaporative emissions system 104 is purged when the engine 102 is operating such that the operating engine combusts the fuel vapors. Alternatively, the evaporative emissions system 104 and canister 114 may be purged when a rate of fuel vaporization is sufficiently high as described in further detail below. Typically, the CPV 132 and the CVS 138 (if present) are opened during a purge operation to fluidly connect the atmospheric vent 131 with the air intake 108 via the evaporative emissions system 104. Furthermore, the evaporative emissions system 104 and canister 114 may be purged via a reverse purge or back purge, for example, overnight and during a cold soak of the evaporative emissions system 104 as described below, with the canister 114 purging back into the fuel tank 112.

The fuel system 100 may additionally have a recirculation line 150 that provides a passage directly between the fuel filling inlet 118 and the evaporative emissions system 104, and bypasses the fuel tank 112. The vapor recirculation through the recirculation line 150 may reduce air entrainment by fuel flowing into the fuel tank 112 and hence reduce fuel vaporization inside the tank 112. In other examples, the fuel system may be provided without a recirculation line 150.

Various components of the fuel system 100, evaporative emissions system 104, and engine 102 are in communication with a controller 170 or control system. The controller 170 may be provided as one or more controllers or control modules for the various vehicle components and systems. The controller 170 and control system for the vehicle may include any number of controllers, and may be integrated into a single controller, or have various modules. Some or all of the controllers may be connected by a controller area network (CAN) or other system. It is recognized that any controller, circuit or other electrical device disclosed herein may include any number of microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any one or more of the electrical devices as disclosed herein may be configured to execute a computerprogram that is embodied in a non-transitory computer readable medium that is programmed to perform any number of the functions as disclosed herein.

The controller 170 may be in communication with other vehicle sensors or components, such as the fuel tank pressure transducer 124, the fuel lever sensor 122, the closure member sensor 128, a hydrocarbon (HC) sensor, an air particulate sensor, a V2X (Vehicle-to-Everything) receiver or transceiver, and other sensors as described herein. The controller 170 may additionally be in communication with a user interface that is provided on the vehicle, such as a display screen or indicator lamp, or is connected to the vehicle remotely, such as the user's mobile device or cellular phone.

The evaporative emissions system 104 is used to adsorb fuel vapors such as those resulting from refueling, diurnal and running loss vapors, into the canister 114. A second canister 134 may be provided, for example, to meet a diurnal test, or otherwise meet emissions requirements. According to one example, a diurnal test is a two to three day test that measures vehicle hydrocarbon emissions against a limit while the vehicle is inoperative. In one example, the second canister 134 is also known as a bleed canister, and the vehicle is a practically or partial zero emissions vehicles or PZEV.

The second canister 134, or filter 134, adds a restriction to the flow path between the canister 114 and the atmospheric vent 131. The second canister 134 may therefore reduce a flow rate across the canister 134 for flow in either direction through the canister 134, and also may increase a back pressure in the main canister and upstream of the second canister 134 when vapor is flowing from the main canister 114 towards the vent 131. According to one example, the second canister contains a honeycombed material to adsorb fuel vapor, and present a higher flow restriction than the canister 114. In other examples, the second canister 134 contains a monolithic element, or another structure for adsorption of fuel vapor with a complex air flow path and presents a high restriction to flow therethrough. The monolithic or honeycombed material of the secondary canister 134 presents a higher flow restriction or pressure drop in comparison to the pellets contained within the canister 114. For a filter 134 as a particulate filter, a flow restriction is similarly provided to the flow path from the vent 131 to the canister 114.

During fueling of the fuel tank 112, increasing liquid fuel into the tank 112 displaces vapor within the tank volume. This displaced vapor may be adsorbed by the canister 114 and/or the secondary canister 134. Additionally, during diurnal cycles while the vehicle is inoperative, fuel vapors may be adsorbed by the canister 114 and/or the secondary canister 134. Likewise, for running losses. Once canister(s) 114, 134 are loaded with fuel vapors, the canisters 114, 134 may be emptied using a purge process while the engine 102 is operating. The CPV 132 is opened and the engine 102 running manifold vacuum in the air intake 108 is used to draw fuel vapor out from the canister and into the engine 102 in a process known as purging. Alternatively, a process known as back purging may occur to empty or partially empty the canister, as described below. In either event, atmospheric air displaces the adsorbed vapors in the main canister. The secondary canister 134 or filter may impede or restrict a purging process. For example, the secondary canister may provide a flow restriction for atmospheric air flowing to the canister 114, or the air flow allowed across the secondary canister and into the main canister may be unable to keep up with a fuel rate of vaporization. Under these types of circumstances, the main canister 114 may be unable to be undergo a purge process, or a purge may be unable to be fully completed.

During refueling, the secondary canister 134 or filter may impede or restrict a fueling operation as it increases the back pressure within the canister 114 and also within the fuel tank 112. The increased back pressure within the tank 112 may cause an interruption in the fueling process, for example, if the pressure increases to the point that an automatic cutoff switch causes the dispensing device, e.g. a fuel pump, to stop pumping fuel into the fuel tank 112. In one example, flash of the fuel in the fuel tank may cause the interruption. Fuel flash may be affected by a temperature delta between the in-ground liquid fuel storage and the skin or walls of the fuel tank 112. Also, the fuel Reid vapor pressure (RVP) or volatility affects flash, with higher RVPs causing higher pressures within the fuel tank 112.

A filter assembly 180 is provided to selectively couple and decouple the second canister 134 with the canister 114. The assembly 180 may physically move the second canister 134 relative to the canister 114. The assembly 180 is described in further detail below with reference to FIGS. 2-6. The assembly 180 may be actuated in response to a fueling operation to decouple the secondary canister 134 or filter 134 from the canister 114 such that the canister 114 directly vents into atmosphere, and the secondary canister 134 with the high flow restriction is removed from the flow path thereby reducing back pressure in the canister 134 and fuel tank 112. The assembly 180 may then be actuated in response to the fueling process being completed to couple the secondary canister 134 to the canister 114 such that the canister 114 is in fluid communication with atmosphere via the secondary canister 134 and vent 131.

Figure 2:
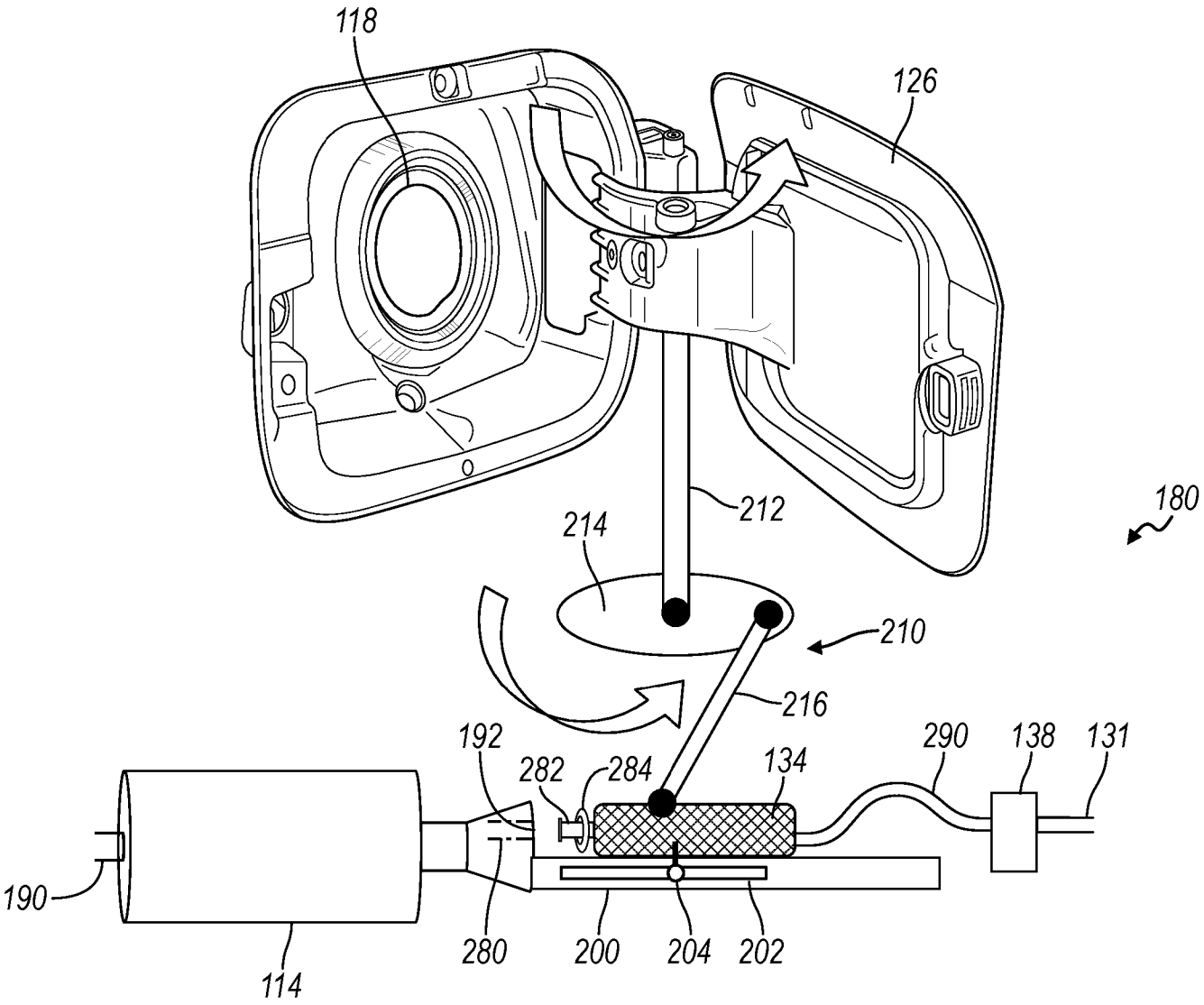
FIG. 2 illustrates a partial schematic view of an evaporative emission system according to an embodiment and for use with the fuel system of FIG. 1 in a first position.
Figure 3:
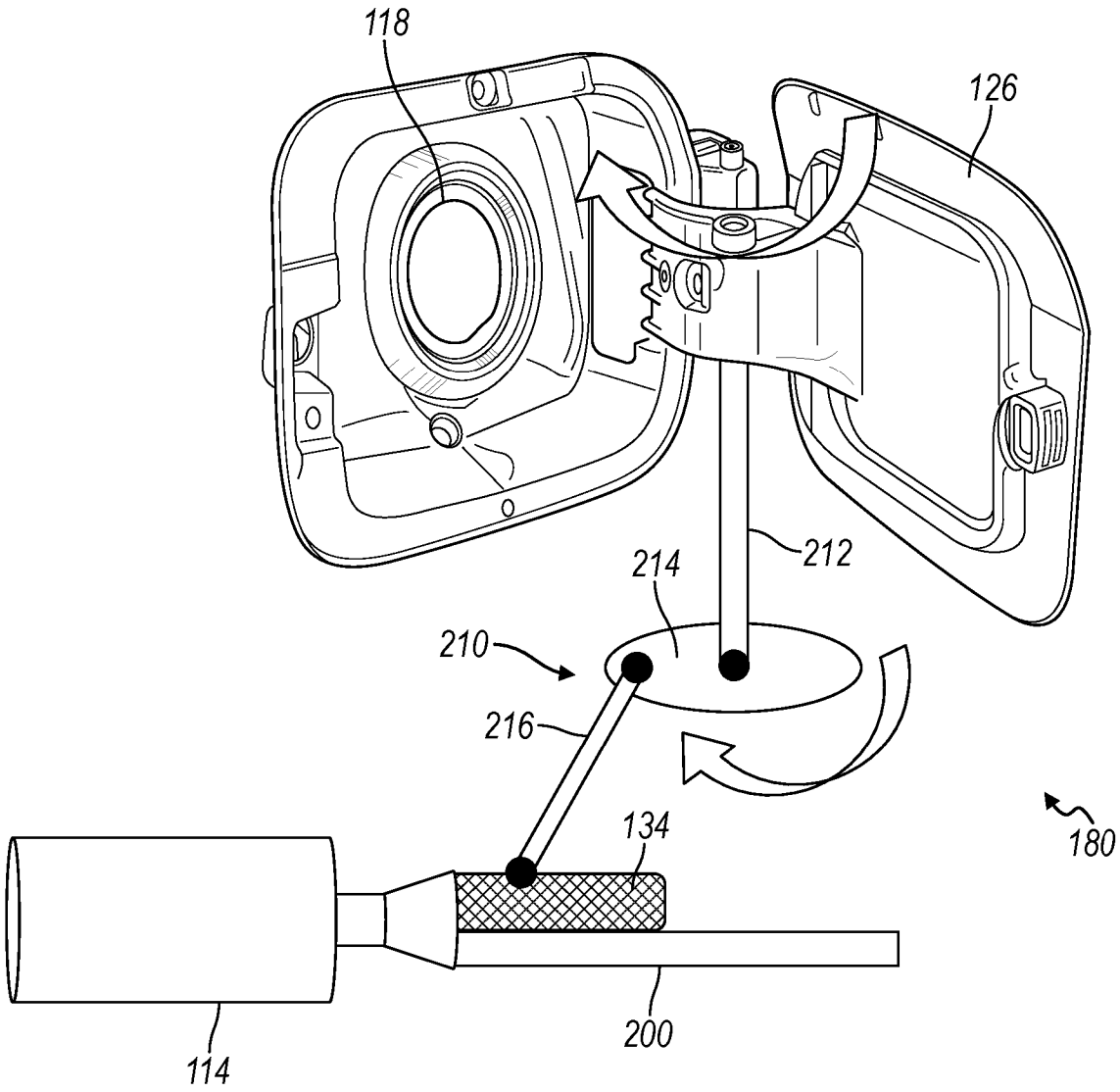
FIG. 3 illustrates a partial schematic view of the evaporative emission system of FIG. 2 in a second position.

FIGS. 2-3 illustrate schematic views of the assembly 180 and a portion of the evaporative emissions system 104. FIG. 2 illustrates the secondary canister 134 in a first position or decoupled position. FIG. 3 illustrates the secondary canister 134 in a second or coupled position. As shown by FIGS. 2-3, the assembly 180 physically moves or translates the secondary canister 134 relative to the canister 114 and between the first and second positions. Elements that are the same as or similar to those described above with reference to FIG. 1 have the same reference numbers for simplicity.

As shown in FIGS. 2-3, the canister 114 has a first port 190 and a second port 192. The first port 190 is fluidly coupled to the fuel tank 112 to receive vapor therefrom. The second port 192 is configured to connect to the second canister 134. The canister 134 is therefore positioned between an air intake for an engine and a vent 131 to atmosphere as described above.

The assembly 180 has a bracket 200. The bracket 200 supports the second canister 134 for movement or translation between the first and second positions. The bracket 200 may be connected to a vehicle frame member, the chassis, or another support element of the vehicle. In one example, the bracket 200 supports the second canister 134 for linear translation between the first and second positions as shown. In a further example, the second canister 134 is constrained for linear translation only relative to the bracket 200 and in a single degree of freedom.

The second canister 134 fluidly couples the second port 192 of the canister 114 to the vent 131 in the first position, and the second canister 134 is spaced apart from and decoupled from the second port 192 of the canister in the second position. The second port 192 of the canister 114 is in direct fluid communication with atmosphere as shown in FIG. 2 when the second canister 134 is in the second position. In one example, direct fluid communication means that there are no filters or canisters in the flow path between the port or element and atmosphere. In a further example, direct fluid communication means that there are no filters, canisters, valves, or other similar elements between the port and atmosphere; however, elements such as a tubing section, a tubing junction, or the like may be present. The second port 192 of the canister is in fluid communication with atmosphere via the second canister 134 and vent 131 when the second canister 134 is in the first position as shown in FIG. 3.

The canister 114 may additionally be supported by and connected to the bracket 200. In one example, the canister 114 is mounted to the bracket 200 such that the canister 134 does not move relative to the bracket 200.

According to one example, the bracket 200 defines a guide 202 with a first end and a second end. The guide 202 may be a track, a slot, or the like. The second canister 134 has a guide member 204 connected to it and extending therefrom. The guide member 204 is engaged with the guide 202 to control movement of the second canister 134 relative to the canister 114 and bracket 200. The guide member 204 may additionally cooperate with the guide 202 to prevent the second canister 134 from lifting or otherwise moving relative to the bracket 200, and maintain the second canister 134 along a path defined by the guide between the first and second positions.

In one example, and as shown, the assembly 180 has at least one linkage 210 that connects the closure member 126 to the second canister 134 to control the position of the second canister 134.

In the example shown in FIGS. 2-3, the assembly 180 include a shaft 212 that is connected to the closure member 126. The shaft 212 rotates as the closure member 126 rotates on its hinge. The shaft 212 is therefore mechanically coupled to the closure member 126 for rotation therewith. The shaft 212 is connected to and drives a disc 214. At least one linkage 216 is connected to the disc 214 and also connected to the second canister 134. As the disc 214 rotates with the shaft 212, the linkage 216 converts rotational motion to linear motion to move the second canister 134 between the first position and the second position. In a further example, the disc 214 and linkage 216 may be provided by a pinion and rack, respectively.

Movement of the closure member 126, or door, from the closed position to the open position rotates the shaft 212 to drive the at least one linkage 216 to move the second canister 134 from the first position to the second position. Movement of the closure member 126 from the open position to the closed position rotates the shaft 212 to drive the at least one linkage 216 to move the second canister 134 from the second position to the first position.

Figure 4:
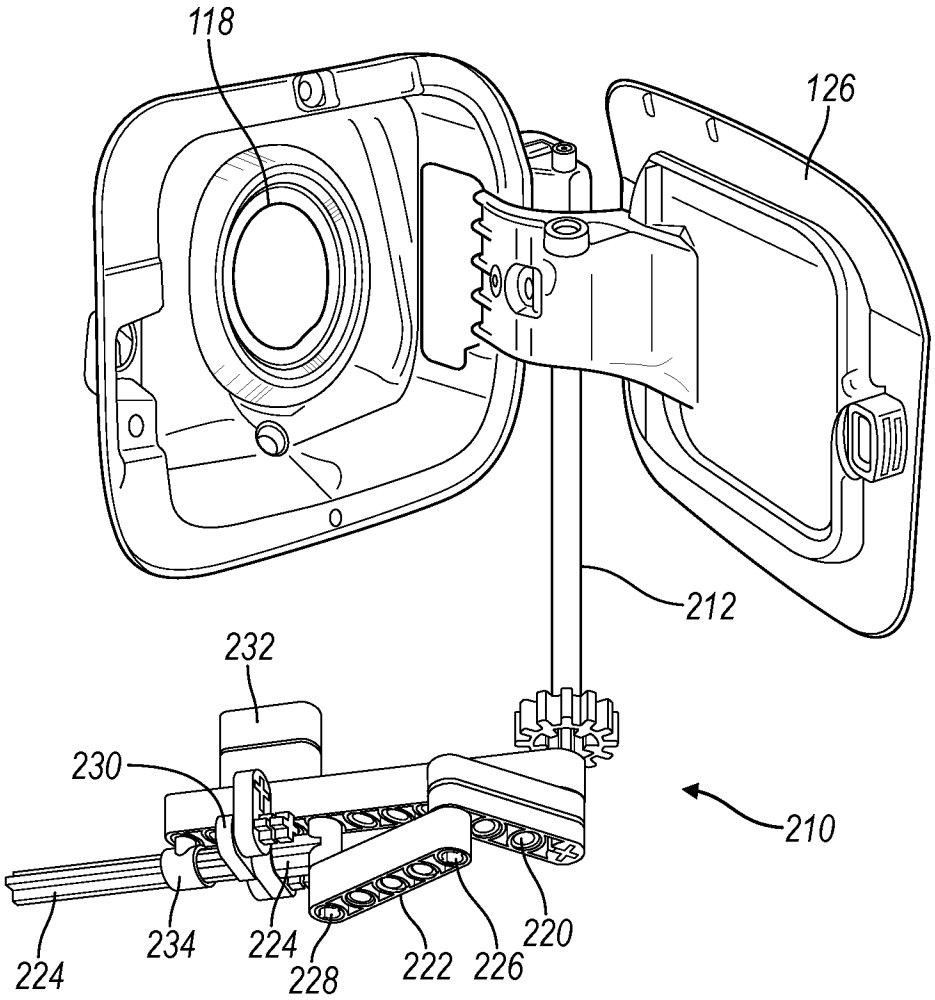
FIG. 4 illustrates a partial schematic view of an evaporative emission system for use with the fuel system of FIG. 1 according to a further embodiment.

In a further example, and as shown in FIG. 4, the at least one linkage 210 includes a first linkage 220, a second linkage 222, and a third linkage 224 that are rotatably connected to one another. The second canister 134 is connected to a mount 232 on a sliding bracket 230 on the bracket 200, with the sliding bracket 230 acting as the guide member, and the structure of the bracket 200 itself acting as the guide. The first linkage 220 has a first end region that is connected for rotation with the shaft 212. The second end region of the first linkage 220 is rotatably connected to the first end region of the second linkage 222, for example, using a pin 226. The second end region of the second linkage 222 is connected to the third linkage 224 via another pin 228. The third linkage 224 extends through a guide slot 234 defined by the bracket 200, and translates linearly relative to the bracket 200. The third linkage 224 is connected and fixed relative to the sliding bracket 230 such that the sliding bracket 230 and mount 232 for the second canister move with the third linkage 224. As the shaft 212 rotates, the first, second, and third linkages 220, 222, 224 move, and the sliding bracket 230 translates relative to the bracket 200. The third linkage 224 and guide slot 234 control the location of the second canister, and define the path of travel between the first and second positions.

Figure 5:
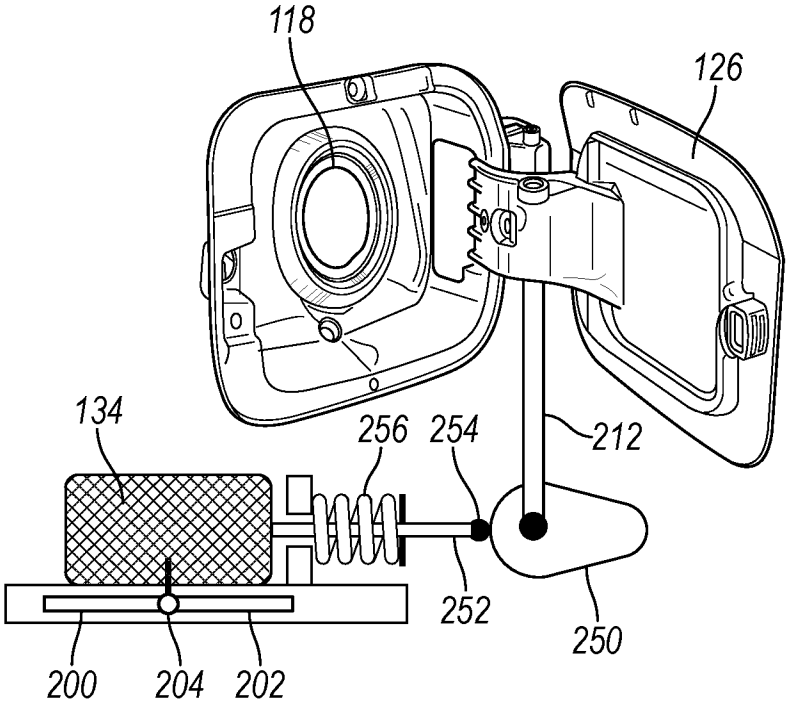
FIG. 5 illustrates a partial schematic view of an evaporative emissions for use with the fuel system of FIG. 1 according to another further embodiment.

In a further example, and as shown schematically in FIG. 5, the shaft 212 is connected to a cam 250 that rotates with the shaft. Additional gearing or other elements coupling the shaft 212 to the cam 250 may additionally be provided. A linkage 252 is coupled to the second canister, and has a follower 254 in contact with the surface of the cam 250. A biasing member 256, such as a spring, may additionally be provided to bias the follower 254 towards the cam 250.

Figure 6:
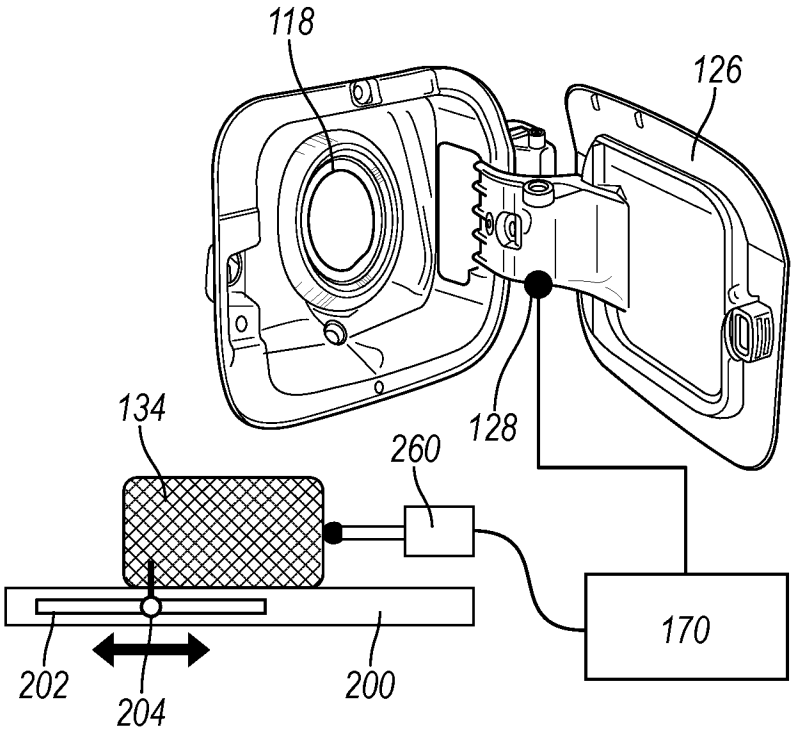
FIG. 6 illustrates a partial schematic view of an evaporative emissions for use with the fuel system of FIG. 1 according to a further embodiment.

In further examples, and as shown in FIG. 6, the assembly 180 may include a solenoid or other linear actuator 260 that is connected to the second canister 134 and also supported by the bracket 200. The linear actuator 260 may be electronically controlled by the controller 170 to move the second canister 134 to the first position or the second position in response to receiving a signal from the controller 170. The controller 170 may control the actuator 260 to one of the two positions based on a signal from a sensor 128 associated with the closure member 126.

Referring back to FIG. 2, and for use with the systems as described above with respect to FIGS. 1-6, the canister 114 has a first fitting 280 defining the second port 192. The first fitting 280 defines a first cylindrical mating surface. Although the first cylindrical mating surface is shown as a female fitting, it is also contemplated that a male fitting may be used as fitting 280. The second canister 134 has a second fitting 282 defining a second cylindrical mating surface to mate with the first cylindrical mating surface when the second canister 134 is in the coupled position of FIG. 3. Although the first cylindrical mating surface is shown as a female fitting, it is also contemplated that a male fitting may be used as fitting 280 and a female fitting as fitting 282. A sealing member 284 is supported by one of the first and second fittings, with the sealing member 284 positioned between the first and second cylindrical mating surfaces when the second canister 134 is in the coupled position.

For an evaporative emissions system with a CVS 138, the CVS 138 is positioned between and fluidly connects the second canister 134 to the atmospheric vent 131. The CVS 138 may be mounted on the vehicle structure, and therefore, the second canister 134 moves relative to the CVS 138. In various examples, the second canister 134 is therefore connected to the CVS 138 via a flexible hose 290 or tube, such as a polyurethane or vinyl tubing, braided hose, or the like.

In other examples, and when the evaporative emissions system 104 is provided without a CVS 138, the second canister 134 itself may define the atmospheric vent, or a flexible hose 290 may be provided between the second canister 134 and an additional filter element such as filter 136.

Figure 7:
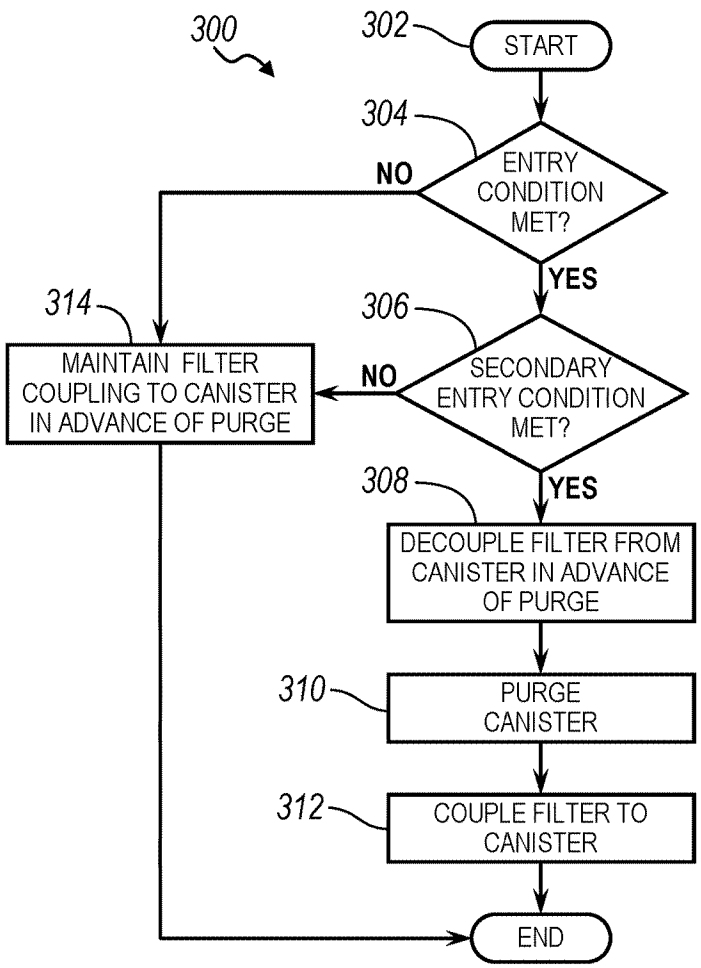
FIG. 7 illustrates a flow chart of a method of controlling a vehicle fuel system according to an embodiment.

FIG. 7 illustrates a method 300 of controlling an evaporative emissions system 104 and fuel system 100, such as the evaporative emission and fuel systems of FIGS. 1-6. Elements that are the same as or similar to those described above with respect to FIGS. 1-6 are given the same reference number for simplicity. Additionally, and according to other examples, steps in the method may be performed sequentially or simultaneously to one another, or may be performed in a different order. The method 300 may also include additional steps to those described below, or may be performed with fewer steps than shown and described.

The method 300 starts at step 302. At step 304, the controller 170 determines whether an entry condition associated with a secondary air flow path for a purge of the canister 114 has been met. In one example, the controller 170 receives a signal indicative of the entry condition. The entry condition is generally indicative of a desire to bypass the filter 134, filter 136, CVS 138, and/or the vent 131 during a purge process. The entry condition may be met under different circumstances as described below.

Figure 8:
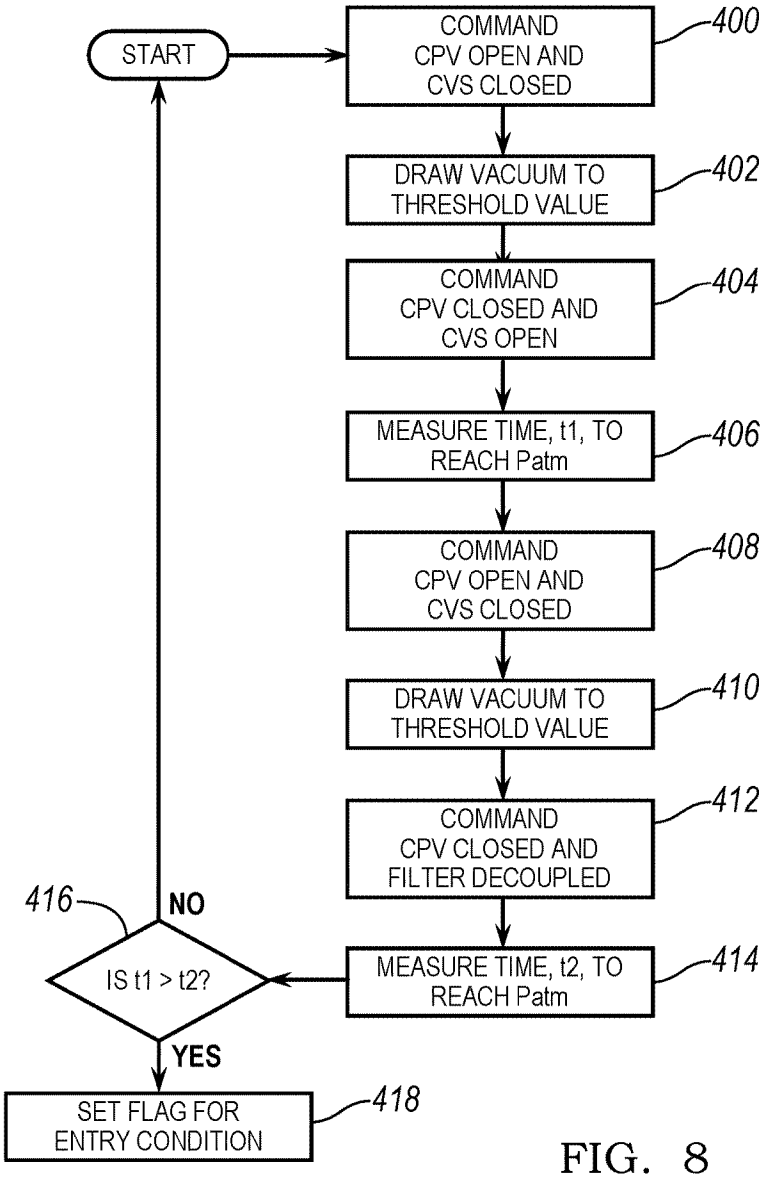
FIG. 8 illustrates a flow chart of a method of determining an entry condition according to an embodiment, and for use with the method of FIG. 7.

According to a first non-limiting example, and as shown in FIG. 8, the entry condition is provided by a flow restriction between the canister 114 and the vent 131. In one example, debris may be present in the evaporative emissions system 104 between the canister 114 and the vent 131, the CVS 138 may have a fault, or the like.

At step 400, the controller 170 commands the CPV 132 to an open position, and commands the CVS 138 to a closed position, with the filter 134 coupled to the canister 114. At step 402, a vacuum is drawn on the evaporative emissions system 104 with the filter 134 coupled to the canister 114. The vacuum may be drawn via the air intake 108 as the vehicle and engine are operating, e.g. during a generally steady state vehicle operating condition. The vacuum is drawn to a pressure threshold or vacuum level. In one example, the pressure threshold is 10 inH2O, or 2.5 kPa, below atmospheric pressure. In other examples, a higher or lower pressure threshold may be used. Once the target pressure threshold is reached, the controller 170 commands the CPV 132 to the closed position, and command the CVS 138 to the open position with the filter 134 coupled to the canister 114 at step 404. At step 406, the controller 170 then monitors and measures the time, t1 or a first time, until the canister 114 and evaporative emissions system 104 reaches atmospheric pressure, Patm.

At step 408, the controller commands the CPV 132 to an open position and commands the CVS 138 to a closed position with the filter 134 coupled to the canister 114. At step 410, a vacuum is drawn on the evaporative emissions system 104. The vacuum may be drawn via the air intake 108 as the vehicle and engine are operating, e.g. during a generally steady state vehicle operating condition. The vacuum is drawn to the same pressure threshold or vacuum level as step 402 above. Once the target pressure threshold is reached, the controller 170 commands the CPV 132 to the closed position, and commands the filter 134 to be decoupled from the canister 114 at step 412. The controller 170 then monitors and measures the time, t2 or a second time, until the canister 114 and evaporative emissions system 104 reaches atmospheric pressure at step 414.

At step 416, the controller 170 compares the first time to the second time. If the first time is equal to or substantially equal to the second time, the entry condition is not met. If the first time is greater than the second time, then the entry condition is met, the controller 170 sets a flag at step 418, and there may be a flow restriction in the filter 134, filter 136 if present, CVS 138, and/or vent 131. Substantially, as used herein, is a value that is within five percent of the given value, within 10 percent of the given value, or within twenty percent of the given value.

Referring back to FIG. 7, and according to a second non-limiting example, the entry condition at step 304 is provided by fuel that is vaporizing within the fuel system 100 and canister 114. The controller 170 may determine the entry condition has been met based on a rate of vaporization of fuel in a fuel tank 112 being greater than a threshold value. For example, if the rate of vaporization of the fuel is greater than the rate of purging, then it may be desirable to decouple the filter 134 from the canister 114 to remove flow restrictions provided by components between the canister 114 and vent 131 to atmospheric air, and increase air flow through the canister 114. In various examples, certain drive cycles, such as city stop and go traffic, towing while driving up a grade, and others may result in a condition where the fuel vaporizes faster than the purge flow, and the purge process may become overwhelmed.

According to a further example, the controller 170 may infer the rate of vaporization from the FTPT sensor 124. Often when purging with cool or moderate temperature fuel, a vacuum develops inside the evaporative emissions system 104 based on the vacuum drawn on the system 104 from the intake manifold 108 vacuum. When the fuel is at a higher temperature or higher Reid vapor pressure (RVP) after the vehicle has been driven on a high ambient temperature day, the rate of the fuel vaporization may be greater than the rate of purging, and the pressure may increase inside the canister 114 and fuel evaporative emissions system 104 during a purge process instead of decreasing to a vacuum. For example, during purging of the canister through the filter, there is typically a vacuum in the evaporative emissions system and fuel system in the range of −2 to −6 InH2O below ambient or atmospheric pressure. When the FTPT sensor measures a positive pressure, or pressure above ambient or atmospheric pressure, during purging instead of the negative pressure or vacuum described above, the controller may infer that the canister purge cannot keep up with rate of vaporization of the fuel, and determine that the entry condition has been met. The controller 170 may determine that the entry condition has been met based on the increase in pressure as measured by the FTPT sensor. According to the present step and entry condition, the canister 114 may be purged via decoupling the filter when the temperature is of approximately twenty degrees Fahrenheit or above. With the filter coupled to the canister, the temperature range for purging the canister 114 would be in the range of approximately 40-95 degrees Fahrenheit. By decoupling the filter from the canister 114, purging of the canister is therefore available across a wider temperature range.

According to another further example, the controller 170 may detect the rate of fuel vaporization as being greater than the rate of purge using a hydrocarbon (HC) sensor at the second port 280 or vent-side port of the canister 114, where the controller 170 determines that the rate of fuel vaporization as being greater than the rate of purge if the HC sensor detects hydrocarbons above a threshold value during a purge process, and that the entry condition is met. Alternatively, the controller 170 may detect that the rate of fuel vaporization is greater than the rate of purge using a temperature sensor positioned adjacent to or within the carbon bed of the canister 114 near the second port 280 or vent-side port of the canister 114, wherein the controller 170 determines that the rate of fuel vaporization as being greater than the rate of purge based on a temperature increase during purge as activated carbon heats up when vapor is adsorbed, and that the entry condition is met.

Additionally, the rate of fuel vaporization may be greater than the rate of purging when the vehicle is provided with an engine that operates at a low intake manifold vacuum, for example, an engine with twin independent variable cam timing (TiVCT).

According to a third non-limiting example, the entry condition at step 304 is based on a predicted cold soak of the evaporative emissions system 104 to account for a back purge or reverse purge condition. During a reverse purge of the canister 114, the atmospheric air flows from the canister 114 and into a fuel tank 112, and the vehicle is inoperative. A reverse purge commonly occurs after a refueling event followed by a short or mild drive cycle and vehicle shut down or key off event. After a vehicle shut down or key off event, if the vehicle is inoperative for a sufficiently long time such that the evaporative emissions system 104 and fuel system 100 reaches a cold soak, or reaches ambient temperature, a reverse purge may occur during the cooldown hours of a diurnal temperature cycle. As the fuel cools down with decreasing ambient temperature, it condenses in the fuel tank 112 and creates a vacuum in the fuel tank 112 compared to atmospheric pressure. The vacuum created may be sufficiently high such that atmospheric air may be drawn from the vent 131 and through the canister 114 to the fuel tank 112 at a rate of 1 L/minute or higher, which can be used to purge the canister 114.

The controller 170 may receive a signal indicative of a predicted key off time and duration of key off, or may determine a predicted key off time and duration of key off for the vehicle. In one example, the signal may be based on a user-learned history for key off duration as a function of the time of day and day of week. If the key off duration is predicted to be into or across overnight hours or a nocturnal timespan, then the controller 170 may determine that the entry condition is met.

Note that the method 300 and controller 170 may monitor for more than one type of entry condition as described above, and may proceed from step 304 to step 306 if any of the entry conditions described above with respect to step 304 are met.

The method then proceeds to step 306 if the entry condition is met at step 304. At step 306, the controller 170 may monitor for a secondary entry condition, and receive a signal indicative of an atmospheric air particulate concentration. The controller 170 may receive the signal indicative of the atmospheric air particulate concentration from an atmospheric air particulate sensor onboard the vehicle, or from a remote sensor onboard another vehicle (with the controller in communication with the other vehicle) or from another remote sensor via V2X communication. The controller 170 may monitor the atmospheric particulate levels, to limit drawing dust in the atmospheric air into the canister 114 and other evaporative emissions system 104 or vehicle components when purging the canister 114 and while bypassing the filter 134. If the atmospheric air particulate concentration is below a threshold value, the controller 170 determines that the secondary entry condition has been met and proceeds to step 308 below. Note that in other examples, step 306 is optional and may be omitted.

At step 308, the controller 170 monitors for the request or initiation of a purge process for the canister 114. In advance of the purge process beginning, the filter 134 is decoupled from the second port 280 of the canister 114 at step 308. The controller 170 may send a signal with instructions to decouple the filter 134 from the second port 280 of the canister 114 in response to meeting the entry condition and secondary entry condition, and during a purge of the canister 114. The filter 134 may be decoupled in response to receiving the signal and prior to the canister 114 purge such that the port 280 is in direct fluid communication with atmosphere.

According to one example, the filter 134 is decoupled from the port of the evaporative emissions canister 114 by opening a closure member 126 for a fuel fill port of a fuel tank. The controller 170 may send a second signal with information indicative of instructions to open the closure member 126 to a user interface. The user would then need to open the closure member 126 in order to decouple the filter 134.

According to another example, the controller 170 may control an actuator, such as actuator 260, to a first position to decouple the filter 134 from the canister 114. If the fuel door 126 is equipped with another actuator to open the fuel door, the controller 170 may control such actuator to open the fuel door 126 and decouple the filter 134 from the canister 114. The controller 170 may provide a notification to the user that the filter 134 has been decoupled, e.g. via a visual or audible notification to the user interface.

At step 310, the canister 114 is purged by flowing atmospheric air into the port 280 and through the canister 114 while the filter 134 is decoupled from the port 280. The canister 114 may be purged by opening the CPV 132 while the engine 102 is operating such that vapor flows from the canister 114 into the intake 108 based on the entry conditions described above with respect to FIG. 8 or for fuel vaporization. If the entry condition relating to the reverse purge is met, the canister 114 is purged by maintaining the CPV 132 in a closed position such that vapor flows from the canister 114 to the fuel tank 112.

At step 312, and after the purge process has been completed or is commanded to end by the controller 170, the filter 134 is coupled to the port 280 of the canister 114. The controller 170 may send a signal with instructions to couple the filter 134 to the port of the evaporative emissions canister 114 after the canister is purged.

In one example, the filter 134 is coupled to the port of the canister 114 by closing the closure member 126 to cover the fuel fill port such that the canister 114 is in fluid communication with atmosphere via the filter 134 and vent 131.

According to another example, the controller 170 may control an actuator, such as actuator 260, to a first position to couple the filter 134 to the canister 114. The controller 170 may provide a notification to the user that the filter 134 has been coupled, e.g. via a visual or audible notification to the user interface.

At step 314, the entry condition has not been met, or the secondary entry condition has not been met, and a purge process is being initiated. In this case, the filter 134 is maintained as coupled to the port of the canister 114 while purging the canister 114 by flowing atmospheric air through the vent 131 and filter 134, into the port 280, and through the canister 114. The controller 170 may command the CVS 138 to an open position during the purge process. If the engine 102 is operating, the controller 170 would also command the CPV 132 to an open position to allow flow into the intake 108. If the engine 102 is not operating, and the canister 114 is back purging or reverse purging, e.g. during a cold soak, the controller 170 maintains the CPV 132 in a closed position such that vapor flows from the canister 114 into the fuel tank 112.

While various embodiments are described above, it is not intended that these embodiments describe all possible forms of the disclosure or invention. Rather, the words used in the specification are words of description rather than limitation, and it is understood that various changes may be made without departing from the spirit and scope of the disclosure. Additionally, the features of various implementing embodiments may be combined to form further embodiments of the disclosure and invention.

What is claimed is:

1. A method of controlling an evaporative emissions system for a vehicle, the method comprising:

receiving a signal indicative of an entry condition associated with a secondary air flow path for a purge of an evaporative emissions canister;

decoupling a filter from a port of the evaporative emissions canister in response to receiving the signal and prior to the purge of the evaporative emissions canister;

purging the evaporative emissions canister by flowing atmospheric air into the port and through the evaporative emissions canister while the filter is decoupled from the port; and coupling the filter to the port of the evaporative emissions canister after purging the canister.

2. The method of claim 1 wherein the filter is decoupled from the port of the evaporative emissions canister by opening a closure member for a fuel fill port of a fuel tank; and wherein the filter is coupled to the port of the evaporative emissions canister by closing the closure member to cover the fuel fill port such that the canister is in fluid communication with atmosphere via the filter.

3. The method of claim 2 further comprising sending a second signal with information indicative of instructions to open the closure member to a user interface.

4. The method of claim 1 further comprising controlling an actuator to a first position to couple the filter to the evaporative emissions canister, and controlling the actuator to a second position to decouple the filter from the evaporative emissions canister.

5. The method of claim 1 wherein the filter is decoupled from a port of the evaporative emissions canister in response to receiving a second signal indicative of an atmospheric air particulate concentration being below a threshold value.

6. The method of claim 1 further comprising:

drawing a vacuum on the evaporative emissions canister with the filter coupled to the port of the evaporative emissions canister, and monitoring a first time for a pressure in the canister to reach a pressure threshold;

drawing a vacuum on the evaporative emissions canister with the filter uncoupled from the port of the evaporative emissions canister, and monitoring a second time for the pressure in the canister to reach the pressure threshold; and setting a diagnostic flag indicating the entry condition in response to the first time being greater than the second time.

7. The method of claim 1 wherein the entry condition is based on a rate of vaporization of fuel in a fuel tank being greater than a threshold value.

8. The method of claim 1 wherein the entry condition is based on a predicted cold soak of the evaporative emissions system; and wherein during purging of the evaporative emissions canister, the atmospheric air flows from the canister and into a fuel tank, and the vehicle is inoperative.

9. The method of claim 1 further comprising opening a valve fluidly connecting the evaporative emissions canister to an intake manifold of an internal combustion engine while purging the evaporative emissions canister.

10. The method of claim 9 further comprising operating the internal combustion engine while purging the evaporative emissions canister.

11. The method of claim 1 further comprising, if no signal is received, maintaining the filter as coupled to the port of the evaporative emissions canister while purging the evaporative emissions canister by flowing atmospheric air through the filter, into the port, and through the evaporative emissions canister.

12. A fuel system for a vehicle comprising:

a fuel tank having a fuel fill port with a closure member;

an evaporative emissions canister having a first port fluidly coupled to the fuel tank to receive vapor therefrom and a second port, the canister positioned between an air intake for an engine and a vent to atmosphere; and a filter supported by a bracket for movement between a first position and a second position, the filter fluidly coupling the second port of the canister to the vent in the first position, and the filter spaced apart from and decoupled from the second port of the canister in the second position such that the second port of the canister is in fluid communication with atmosphere; and a controller configured to: receive a first signal indicative of an entry condition associated with a secondary air flow path for a purge of an evaporative emissions canister, send a second signal with instructions to decouple the filter from the second port of the evaporative emissions canister in response to receiving the first signal and during the purge of the evaporative emissions canister, and send a third signal with instructions to couple the filter to the second port of the evaporative emissions canister after the canister is purged.

13. The fuel system of claim 12 wherein the controller is further configured to (i) command a valve fluidly connecting the canister to an engine intake to an open position to draw a vacuum on the evaporative emissions canister with the filter coupled to the second port, command the valve to a closed position, and monitor a first time for a pressure in the canister to reach a pressure threshold, (ii) command the valve to the open position to draw a vacuum on the evaporative emissions canister with the filter uncoupled from the port of the evaporative emissions canister, command the valve to the closed position, and monitor a second time for the pressure in the canister to reach the pressure threshold, and (iii) set a diagnostic flag indicating the entry condition in response to the first time being greater than the second time.

14. The fuel system of claim 12 wherein the entry condition is based on a rate of vaporization of the fuel in the fuel tank being greater than a threshold value.

15. The fuel system of claim 12 wherein the entry condition is based on a predicted cold soak of the evaporative emissions canister; and wherein the controller is further configured to command purging the evaporative emissions canister such that atmospheric air flows from the canister into the fuel tank when the vehicle is inoperative.

16. The fuel system of claim 12 wherein the filter is supported for translation along the bracket between the first and second positions; and wherein the filter is connected via at least one linkage to the closure member.

17. The fuel system of claim 12 further comprising an actuator connected to the filter to move the filter along the bracket between the first and second positions.

18. The fuel system of claim 12 wherein the filter is a second evaporative emissions canister.

19. The fuel system of claim 12 further comprising a canister vent valve, wherein the canister vent valve and the filter fluidly connect the second port to the vent.

20. A vehicle comprising:

an engine having an air intake;

a fuel tank with a fuel fill port and a closure member movable between a closed position to cover the fuel fill port and an open position to fuel the fuel tank via the fuel fill port;

an evaporative emissions canister having a first port fluidly coupled to the fuel tank to receive vapor therefrom and a second port, the canister fluidly connecting the air intake to a vent to atmosphere;

a filter supported by a bracket for movement between a first position and a second position, the filter fluidly coupling the second port of the canister to the vent in the first position, and the filter spaced apart from and decoupled from the second port of the canister in the second position; and a controller configured to: receive a first signal indicative of an entry condition associated with a secondary air flow path for a purge of an evaporative emissions canister, send a second signal with instructions to decouple the filter from the second port of the evaporative emissions canister in response to receiving the first signal and during the purge of the evaporative emissions canister, and send a third signal with instructions to couple the filter to the second port of the evaporative emissions canister after the canister is purged.

* * * * *